United States Patent [19]

Cornelissen et al.

[11] Patent Number: 4,769,173

[45] Date of Patent: Sep. 6, 1988

[54] ENZYMATIC DETERGENT AND BLEACHING COMPOSITION

[75] Inventors: Johannes M. Cornelissen; Jan Klugkist, both of Vlaardingen; Cornelis A. Lagerwaard; Ton Swarthoff, both of Hellevoetsluis, all of Netherlands; David Thom, Parkgate, Great Britain

[73] Assignee: Lever Brothers Company, New York, N.Y.

[21] Appl. No.: 128,256

[22] Filed: Dec. 3, 1987

[30] Foreign Application Priority Data

Dec. 10, 1986 [GB] United Kingdom ..... 8629534

[51] Int. Cl.[4] ..... C11D 3/386

[52] U.S. Cl. ..... 252/174.12; 252/95; 252/99; 252/135; 252/186.1; 252/551; 252/DIG. 12; 435/263

[58] Field of Search ..... 252/174.12, DIG. 12, 252/94, 95, 99, 186.1, 135, 551; 435/263

[56] References Cited

U.S. PATENT DOCUMENTS 4,011,169 3/1977 Diehl et al. ..... 252/174.12

4,707,291 11/1987 Thom et al. ..... 252/174.12

*Primary Examiner*—Paul Lieberman

*Assistant Examiner*—Hoa Van Le

*Attorney, Agent, or Firm*—Milton L. Honig; James J. Farrell

[57] ABSTRACT

The invention relates to the use of a certain class of lipases together with strong bleaching agents in detergent compositions. This class of lipases consists of fungal lipases ex *Humicola lanuginosa* or *Thermomyces lanuginosus,* and bacterial lipases which show a positive immunological cross-reaction with the antibody of the lipase produced by *Chromobacter viscosum var. lipolyticum* NRRL B-3673. The strong bleaching agents are stronger than the sodium perborate/TAED system, i.e. stronger than peracetic acid or they yield, on perhydrolysis, a peracid faster than the sodium perborate/-TAED system.

6 Claims, No Drawings

ENZYMATIC DETERGENT AND BLEACHING COMPOSITION

The present invention relates to an enzymatic detergent and bleaching composition comprising as essential ingredients a lipolytic enzyme and a bleaching system.

Enzymatic detergent and bleaching compositions are well known in the art. They normally comprise proteolytic and/or amylolytic enzymes and a bleaching system usually consisting of sodium perborate, either as such or in admixture with a low temperature bleach activator, e.g. tetraacetyl ethylene diamine (TAED). Although lipolytic enzymes have been mentioned in the prior art as possible enzymes for inclusion in detergent compositions, there is relatively little prior art specifically concerned with lipases for inclusion in detergent and bleaching compositions.

In a rather recent article in the "Journal of Applied Biochemistry", 2 (1980), pages 218–229, Andree et al. have reported their investigations of lipases as detergent components. They found that pancreatic lipase and Rhizopus lipase were both unstable in detergent solutions which contained a mixture of an anionic and a nonionic synthetic detergent, pentasodium triphosphate and sodium perborate, whereas these lipases were far less unstable in solutions with sodium perborate alone.

In the prior art, as far as we are aware, there is no clear teaching about the compatibility or incompatibility of lipases and bleaching systems, and consequently one cannot predict which lipases would be compatible with which bleaching systems.

In our co-pending patent application No. 8514707, filed in Great Britain on 11 June 1985 we identified a certain class of lipases which are especially suitable for inclusion in detergent compositions. These lipases are significantly less affected by a bleaching system than other lipases. These bleaching systems comprise sodium perborate and TAED.

We have now surprisingly found that a certain class of lipases, which will be defined hereafter, is quite compatible with bleaching systems which are stronger than the sodium perborate/TAED system, such systems being defined in more detail hereafter. Whereas, as stated above, there is no general rule to be found in the prior art concerning which lipases would be compatible with which bleach systems, we have discovered that each member of the class of lipases according to our invention is compatible with bleaching systems which are stronger than the sodium perborate/TAED system. The class of lipases of the present invention consists of fungal lipases producible by *Humicola lanuginosa, Thermomyces lanuginosus* and bacterial lipases which show a positive immunological cross-reaction with the antibody of the lipase produced by the micro-organism *Chromobacter viscosum* var. *lipolyticum* NRRL B-3673. This micro-organism has been described in Dutch patent specification 154 269 of Toyo Jozo Kabushiki Kaisha and has been deposited with the Fermentation Research Institute, Agency of Industrial Science and Technology, Ministry of International Trade & Industry, Tokyo, Japan, and added to the permanent culture collection under nr. Ko Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this micro-organism is commercially available from Toyo Jozo Co, Tagata, Japan, hereafter referred to as "TJ lipase". These bacterial lipases of the present invention should show a positive immunological cross-reaction with the TJ lipase antibody, using the standard and well-known immunodiffusion procedure according to Ouchterlony (Acta. Med. Scan., 133, pages 76–79 (1950)).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant
day 4: antigen in complete Freund's adjuvant
day 32: antigen in incomplete Freund's adjuvant
day 60: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to Ouchterlony procedure. A $2^5$ dilution of antiserum was the dilution that still gave a visible precipitation with an antigen concentration of 0.1 mg/ml.

All lipases showing a positive immunological cross-reaction with the TJ-lipase antibody as hereabove described are lipases according to the present invention. Typical examples thereof are the lipase ex *Pseudomonas fluorescens* IAM 1057 available from Amano Pharmaceutical Co, Nagoya, Japan, under the trade-name Amano-P lipase, the lipase ex *Pseudomonas fragi* FERM P 1339 (available under the trade-name Amano-B), lipase ex *Pseudomonas nitroreducens* var. *lipolyticum* FERM P-1338, the lipase ex *Pseudomonas sp.* available under the trade-name Amano CES, the lipase ex *Pseudomonas cepacia,* lipases ex *Chromobacter viscosum,* e.g. *Chromobacter viscosum* var. *lipolyticum* NRRL B-3673, commercially available from Toyo Jozo Co., Tagata, Japan; and further *Chromobacter viscosum* lipases from US Biochemical Corp., USA and Diosynth Co., The Netherlands, and lipases ex *Pseudomonas gladioli.*

An example of a fungal lipase as defined above is the lipase ex *Humicola lanuginosa,* available from Amano under the trade-name Amano-CE.

The lipases of the present invention are included in the detergent and bleaching composition in such an amount that the final composition has a lipolytic enzyme activity of from 100 to 0.005 LU/mg, preferably 25 to 0.05 LU/mg of the composition.

A Lipase Unit (LU) is that amount of lipase which produces 1 μmol of titratable fatty acid per minute in a pH stat. under the following conditions: temperature 30° C.; pH=9.0; substrate is an emulsion of 3.3 wt.% of olive oil and 3.3% gum arabic, in the presence of 13 mmol/l $Ca^{2+}$ and 20 mol/l NaCl in 5 mmol/l Tris-buffer.

Naturally, mixtures of the above lipases can be used. The lipases can be used in their non-purified form or in a purified form, e.g. purified with the aid of well-known adsorption methods, such as phenyl sepharose adsorption techniques.

Of the lipases according to the present invention, the bacterial cross-reacting lipases are preferred in view of their better overall performance. The bleaching system used according to the present invention is stronger than the sodium perborate/TAED system. This latter system, through a perhydrolysis reaction, forms a peroxyacid, i.e. peracetic acid, but at a rather low rate. The bleaching systems according to the present invention must be stronger than this sodium perborate/TAED system, by which is to be understood that the system either is based on a peracid (inorganic or organic) which is stronger than the peracetic acid or yields, on perhydrolysis, an organic peracid, including peracetic acid, faster than the sodium perborate/TAED system. The bleaching system may consist of a bleaching agent as such or may consist of a bleaching agent together with a bleach precursor. As bleaching agent as such alkali metal monopersulphates, furthermore organic peracids such as diperoxy dodecanedioic acid, diperoxy tetradecanedioic acid, diperoxyhexadecane dioic acid, mono- and diperazelaic acid, mono- and diperbrassylic acid, monoperoxy phthalic acid, perbenzoic acid, can be used, either as acid or in the form of their salts.

When a system comprising a bleach precursor is used, this system comprises a bleaching agent which reacts with a bleach precursor to form a peracid in solution faster than the sodium perborate/TAED system. By faster is meant that the precursor will have a rate of peroxy acid release of at least 2 (two) times, preferably at least 5 (five) times faster than TAED under the same conditions.

Typical examples of such systems are sodium perborate with sodium nonanoyloxy benzene sulphonate or sodium trimethyl hexanoyloxy benzene sulphonate or sodium acetoxy benzene sulphonate or sodium benzoyloxy benzene sulphonate.

The preferred systems of the present invention are sodium perborate with sodium nonanoyloxy benzene sulphonate, diperoxy dodecane dioic acid or monopersulphate.

In general, the amount of the bleaching system in the composition varies from 1–50%, usually from 5–40% by weight. When a bleach precursor is present, the molar ratio of the bleach precursor to the percompound such as sodium perborate varies from 1:1 to 1:35, preferably from 1:2 to 1:20. Mixtures of various bleaching agents and various bleach precursors in accordance with the invention can also be used.

The compositions of the present invention may furthermore contain one or more detergent active materials, such as soaps, anionic, nonionic, cationic and zwitterionic synthetic detergents or mixtures thereof. Usually the amount of detergent active material present in the composition will range from 1–50%, preferably 2–40% and particularly preferably 5–30% by weight. Suitable examples of detergent active materials can be found in Schwartz, Perry and Berch "Surface Active Agents and Detergents", Vol. I (1949) and Vol. II (1958) and M. Schick "Nonionic Surfactants" Vol. I (1967).

The compositions may furthermore include the usual detergent ingredients in the usual amounts. They may be unbuilt or built, and may be of the zero-P type (i.e. not containing phosphorus-containing builders). Thus, the compositions may contain from 1–60%, preferably from 5–30% by weight of one or more organic and/or inorganic builders. Typical examples of such builders are the alkali metal ortho-, pyro- and tripolyphosphates, alkali metal carbonates, either alone or in admixture with calcite, alkali metal citrates, alkali metal nitrilotriacetates, carboxymethyloxy succinates, zeolites, polyacetal carboxylates and so on.

The compositions may furthermore comprise lather boosters, foam depressors, anti-corrosion agents, soil-suspending agents, sequestering agents, anti-soil redeposition agents, perfumes, dyes, stabilizing agents for the enzymes and bleaching agents and so on. They may also comprise enzymes other than lipases, such as proteases, amylases, oxidases and cellulases. In this respect it has been found that, whereas proteases are often affected by strong bleaches, in the present invention, when used together with the lipases of the present invention, the overall performance of the enzyme system is often not significantly affected. In general, the compositions may comprise such other enzymes in an amount of 0.01–10% by weight. For proteases, the amount, expressed in proteolytic activity, is usually from 0.1–50 GU/$_{mg}$ based on the final composition.

A GU is a glycine unit, which is the amount of proteolytic enzyme which under standard incubation conditions produces an amount of terminal $NH_2$-groups equivalent to 1 microgramme/ml of glycine.

The compositions of the present invention can be formulated in any desired form, such as powders, bars, pastes, liquids, etc.

The invention will further be illustrated by way of Example.

EXAMPLE 1

The stability of various lipases in the presence of a bleaching system was measured as follows:

To a solution of 4 g/l of a detergent composition* and 0.03 g/l Dequest 2041 in water with a hardness of 30° FH and a temperature of 30° C., an amount of lipase is added to obtain 15–20 lipase units/ml.

*The detergent composition had the following formulation:

| | % by weight |
|---|---|
| Sodium dodecyl benzene sulphonate | 6.5 |
| $C_{14}$–$C_{15}$ primary alcohol, condensed with 11 moles of ethylene oxide | 2.0 |
| Sodium stearate | 1.0 |
| Sodium silicate | 7.0 |
| Sodium carboxymethyl cellulose | 0.5 |
| $Na_2SO_4$ | 37.0 |
| Pentasodium triphosphate | 15.0 |
| Trisodium orthophosphate | 5.0 |
| Fluorescer | 0.2 |
| Ethylene diamine tetraacetic acid | 0.5 |
| Water | 6.2 |
| Dyes | 0.01 |

The pH is adjusted with NaOH to pH 10.0 at 30° C. At t=0 a bleach system is added:

(a) 292 mg/l TAED (65% pure) and 700 mg/l sodium perborate monohydrate or
(b) 1880 mg/l DPDA (12% pure) or
(c) 822 mg/l SNOBS (80% pure) and 1500 mg/l sodium perborate monohydrate or
(d) 506 mg/l MPS (in the form of the commercial product Caroate®) or
(e) 475 mg/l P15 (95% pure) and 700 mg/l sodium perborate monohydrate.

This yields 1.5 mmolar peracid in solution for all bleach systems. The lipase stability is measured by determining the residual lipase activity with the pH-stat. method.

Dequest 2041=ethylene diamine tetra(methylene phosphonic acid)
TAED=tetraacetyl ethylene diamine
DPDA=diperoxy dodecanedioic acid
SNOBS=sodium nonaoyloxy benzene sulphonate
MPS=sodium monopersulphate
P15=sodium benzoyloxy benzene sulphonate

| | | The following results were obtained: | | | | | | | | | | | | | | | | | |
|---|---|---|---|---|---|---|---|---|---|---|---|---|---|---|---|---|---|---|---|
| | | No bleach activity(1) | | | TAED/perb. activity(1) | | | SNOBS/perb. activity(1) | | | DPDA activity(1) | | | MPS activity(1) | | | P15 activity(1) | | |
| Lipase ex. | Trade-name | 10 min | 30 min | $t\frac{1}{2}$ (min) | 10 min | 30 min | $t\frac{1}{2}$ (min) | 10 min | 30 min | $t\frac{1}{2}$ (min) | 10 min | 30 min | $t\frac{1}{2}$ (min) | 10 min | 30 min | $t\frac{1}{2}$ (min) | 10 min | 30 min | $t\frac{1}{2}$ (min) |
| *Humicola lanuginosa* | Amano CE | 92 | 93 | * | 92 | 95 | * | 82 | 80 | * | 95 | 94 | * | 96 | 82 | * | 90 | 83 | * |
| *Thermomyces lanuginosus* | — | 96 | 99 | * | 98 | 98 | * | 81 | 79 | * | 95 | 90 | * | 82 | 78 | * | 85 | 80 | * |
| *Pseudomonas gladioli* | — | 97 | 97 | * | 97 | 92 | * | 90 | 80 | * | 100 | 99 | * | 89 | 80 | * | 92 | 77 | * |
| *Chromobacter viscosum* | Diosynth | 105 | 99 | * | 95 | 93 | * | 95 | 80 | * | 100 | 103 | * | 100 | 96 | * | 100 | 90 | * |
| *Chromobacter viscosum* | Toyo Jozo | 100 | 95 | * | 100 | 86 | * | 80 | 58 | * | 107 | 98 | * | 85 | 62 | * | 93 | 63 | * |
| *Pseudomonas fluorescens* | Amano P | 100 | 98 | * | 92 | 100 | * | 85 | 80 | * | 109 | 100 | * | 89 | 85 | * | 102 | 83 | * |
| *Pseudomonas cepacia* | ex NOVO | 93 | 90 | * | 98 | 94 | * | 89 | 81 | * | 100 | 98 | * | 97 | 96 | * | 95 | 84 | * |
| *Pseudomonas fragi* | Amano B | 101 | 122 | * | 73 | 66 | * | 125 | 125 | * | 91 | 95 | * | 125 | 125 | * | 91 | 88 | * |
| *Pseudomonas fluorescens* | Amano CES | 92 | 89 | * | 102 | 93 | * | 79 | 67 | * | 101 | 96 | * | 104 | 95 | * | 104 | 97 | * |
| *Aspergillus niger* | Amano AP 6 | 110 | 90 | * | 100 | 64 | 43 | 14 | <5 | 2 | 62 | <5 | 12 | 78 | 40 | 24 | 30 | 9 | 7 |
| *Mucor Miehei* | SP 225 | 67 | 46 | 28 | 95 | 58 | 35 | 81 | 46 | 28 | 86 | 68 | * | 13 | <5 | 4 | 73 | 44 | 26 |
| *Fusarium oxysporum* | SP 285 | 23 | <5 | 4 | 23 | <5 | 3 | 30 | <5 | 4 | 24 | <5 | 3 | 25 | <5 | 5 | 23 | <5 | 4 |
| *Mucor miehei* | Esterase MM | 64 | 21 | 15 | 67 | 25 | 16 | 59 | 24 | 12 | 50 | 20 | 10 | 10 | <5 | 4 | 60 | 20 | 12 |
| Alcaligenes species | Lipase PL (batch 1) | 55 | 29 | 13 | 40 | 23 | 7 | 33 | 10 | 6 | nd. | | | nd. | | | nd. | | |
| *Candida cyclindracea* | Lipase MY | <5 | <5 | <1 | <5 | <5 | <1 | <5 | <5 | <1 | <5 | <5 | <1 | <5 | <5 | <1 | <5 | <5 | <1 |
| *Candida cyclindracea* | Lipase MY | <5 | <5 | <1 | <5 | <5 | <1 | <5 | <5 | <1 | <5 | <5 | <1 | <5 | <5 | <1 | <5 | <5 | <1 |
| Rhizopus species | Saiken A A 300 | <5 | <5 | <1 | <5 | <5 | <1 | <5 | <5 | <1 | <5 | <5 | <1 | <5 | <5 | <1 | <5 | <5 | <1 |
| Alcaligenes species ATCC 31371) | Lipase PL ex Meito (batch 2) | 27 | 13 | 4 | 18 | 11 | 4 | <5 | <5 | 2 | 18 | 15 | 5 | 17 | 13 | 5 | 17 | 7 | 4 |
| *Porcine pancreas* | L-3126 Sigma | 15 | <5 | 1 | 5 | <5 | 1 | <5 | <5 | 1 | 13 | <5 | 1 | <5 | <5 | 1 | <5 | <5 | 1 |
| *Rhizopus arrhizus* | 580,000 Rapidase | <5 | <5 | <1 | <5 | <5 | <1 | <5 | <5 | <1 | <5 | <5 | <1 | <5 | <5 | <1 | <5 | <5 | <1 |
| *Mucor javanicus* | M-AP Amano | 31 | <5 | 7 | 21 | <5 | 6 | 27 | <5 | 7 | 90 | 49 | 30 | 16 | <5 | 4 | 36 | <5 | 8 |
| *Candida rugosa* | ENZECO lipase 30,000 | <5 | <5 | <1 | <5 | <5 | <1 | <5 | <5 | <1 | <5 | <5 | <1 | <5 | <5 | <1 | <5 | <5 | <1 |
| Rhizopus species | Lipase 2A Nagase | <5 | <5 | <1 | <5 | <5 | <1 | <5 | <5 | <1 | <5 | <5 | <1 | <5 | <5 | <1 | <5 | <5 | <1 |

-continued

| | | The following results were obtained: | | | | | | | | | | | | | | | | | |
|---|---|---|---|---|---|---|---|---|---|---|---|---|---|---|---|---|---|---|---|
| | | No bleach activity(1) | | | TAED/perb. activity(1) | | | SNOBS/perb. activity(1) | | | DPDA activity(1) | | | MPS activity(1) | | | P15 activity(1) | | |
| Lipase ex. | Trade-name | 10 min | 30 min | $t\frac{1}{2}$ (min) | 10 min | 30 min | $t\frac{1}{2}$ (min) | 10 min | 30 min | $t\frac{1}{2}$ (min) | 10 min | 30 min | $t\frac{1}{2}$ (min) | 10 min | 30 min | $t\frac{1}{2}$ (min) | 10 min | 30 min | $t\frac{1}{2}$ (min) |
| Rhizopus species | Lipase 2B Nagase | <5 | <5 | <1 | <5 | <5 | <1 | <5 | <5 | <1 | <5 | <5 | <1 | <5 | <5 | <1 | <5 | <5 | <1 |
| *Candida cylindracea* | OF 360 Meito Kogyo | <5 | <5 | <1 | <5 | <5 | <1 | <5 | <5 | <1 | <5 | <5 | <1 | <5 | <5 | <1 | <5 | <5 | <1 |
| *Candida cylindracea* | L-1754 Sigma | <5 | <5 | <1 | <5 | <5 | <1 | <5 | <5 | <1 | <5 | <5 | <1 | <5 | <5 | <1 | <5 | <5 | <1 |
| *Rhizopus javanicus* | F-AP Amano | <5 | <5 | <1 | <5 | <5 | <1 | <5 | <5 | <1 | <5 | <5 | <1 | <5 | <5 | <1 | <5 | <5 | <1 |
| *Rhizopus niveus* | N Amano | <5 | <5 | <1 | <5 | <5 | <1 | <5 | <5 | <1 | <5 | <5 | <1 | <5 | <5 | <1 | <5 | <5 | <1 |

*too large to determine from these experiments
(1)residual lipase activity (% of input)
$t\frac{1}{2}$ = half life time

EXAMPLE 2

Various lipases were tested in washing experiments under the following conditions:

| | |
|---|---|
| lipase concentration | 15 LU/ml |
| detergent composition | as in Example 1 |
| dosage | 4 g/l |
| bleach systems | sodium perborate + SNOBS<br>sodium perborate + TAED<br>DPDA<br>MPS<br>All generating 1.5 mmol peracid in solution |
| temperature | heat-up to 30° C.; 40 min in total |
| water hardness | 39° F.H |
| cloth/liquor ratio | 1.8 |
| number of soil/wash cycles | 3 |
| cloths | polyester soiled with mustard or sateh sauce<br>PCBC 1 |

After these soil/wash cycles, the residual percentage of fatty material on the test cloths was determined and the reflectance was measured in a Reflectometer at 460 mm with a UV filter in the light pathway. The residual fatty material was measured by extracting the dried test cloths with petroleum ether, distilling off the solvent and weighing the resulting fatty matter The following results were obtained:

Amount of residual fat* after third cycle

*In % by weight of the extracted cloths.

| Cloth | Sateh sauce | | | | Mustard | | | |
|---|---|---|---|---|---|---|---|---|
| Lipase | TJ AP | AP6 | MY | NO | TJ AP | AP6 | MY | NO |
| SNOBS | 3.0 2.9 | 7.6 | 6.4 | 6.7 | 1.6 1.3 | 2.4 | 2.4 | 2.6 |
| TAED | 3.2 3.1 | 7.2 | 6.7 | 6.5 | 1.7 1.4 | 2.3 | 2.4 | 2.5 |
| DPDA | 2.8 2.8 | 7.3 | 6.3 | 6.4 | 1.6 1.5 | 2.3 | 2.3 | 2.4 |
| MPS | 4.2 2.8 | 7.2 | 6.7 | 6.6 | 1.9 1.4 | 2.3 | 2.5 | 2.4 |
| NO bleach | 3.4 2.8 | 7.2 | 6.7 | 6.7 | 1.6 1.4 | 2.4 | 2.5 | 2.4 |

TJ = Lipase ex Chromobacter viscosum, made by Toyo Jozo
AP = Amano P lipase
AP6 = Amano AP6 lipase
MY = Meito Sangyo lipase
NO = No lipase used Reflectance values of the combined lipase/bleach systems (R460* after third cycle)

| Cloth | Bleach | Lipase TJ | AP | NO |
|---|---|---|---|---|
| Sateh sauce | SNOBS | 73.3 | 73.8 | 69.2 |
| | TAED | 68.5 | 69.3 | 65.7 |
| | NO bleach | 65.7 | 65.5 | 61.9 |
| Mustard | SNOBS | 70.8 | 70.3 | 67.2 |
| | TAED | 64.7 | 65.3 | 62.8 |
| | NO bleach | 61.4 | 63.2 | 60.0 |
| PCBCl | SNOBS | 36.5 | 36.2 | 36.2 |
| | TAED | 34.3 | 33.7 | 33.5 |
| | NO bleach | 27.0 | 26.8 | 26.2 |

EXAMPLE 3

Examples 1 and 2 were repeated, but now in the presence of 20 GU (glycine unit)/ml Savinase ®, a proteolytic enzyme ex NOVO.

The following results were obtained:

| | No bleach activity(1) | | | TAED/perb. activity(1) | | | SNOBS/perb. activity(1) | | |
|---|---|---|---|---|---|---|---|---|---|
| Lipase | 10 min | 30 min | t½ (min) | 10 min | 30 min | t½ (min) | 10 min | 30 min | t½ (min) |
| *Ps. gladioli* | 81 | 56 | 37 | 76 | 51 | 31 | 76 | 55 | 36 |
| Amano P | 51 | 17 | 10 | 56 | 20 | 12 | 40 | 16 | 6 |
| Diosynth | 77 | 45 | 27 | 83 | 53 | 35 | 81 | 62 | >40 |
| Amano CE | 94 | 92 | * | 89 | 71 | * | 64 | 61 | * |
| Amano B | 82 | 71 | * | 63 | 59 | * | 95 | 83 | * |
| Amano CES | 44 | 12 | 8 | 40 | 13 | 8 | 46 | 26 | 9 |
| *Th. lanuginosus* | 89 | 90 | * | 88 | 86 | * | 93 | 90 | * |
| *Ps. cepacia* | 65 | 35 | 18 | 72 | 38 | 19 | 65 | 34 | 19 |
| Toyo Jozo | 79 | 48 | 30 | 71 | 38 | 18 | 72 | 47 | 28 |
| Amano AP6 | 96 | 83 | * | 82 | 38 | 25 | <5 | <5 | 3 |
| Esterase MM | 64 | 21 | 13 | 38 | 15 | 8 | 43 | 12 | 8 |
| Novo SP285 | 18 | <5 | 4 | 16 | <5 | 4 | 16 | <5 | 4 |
| Novo SP225 | 106 | 85 | * | 94 | 68 | * | 94 | 68 | * |
| PL (batch 2) | 28 | 11 | 5 | 20 | 8 | 5 | 11 | <5 | 3 |
| L-3126 | 21 | <5 | 1 | 6 | <5 | 1 | <5 | <5 | 1 |
| S80,000 | <5 | <5 | <1 | <5 | <5 | <1 | <5 | <5 | <1 |
| M-AP | 24 | <5 | 6 | 18 | <5 | 6 | 29 | <5 | 7 |
| ENZECO | <5 | <5 | <1 | <5 | <5 | <1 | <5 | <5 | <1 |
| Lipase 2A | <5 | <5 | <1 | <5 | <5 | <1 | <5 | <5 | <1 |
| Lipase 2B | <5 | <5 | <1 | <5 | <5 | <1 | <5 | <5 | <1 |
| OF 360 | <5 | <5 | <1 | <5 | <5 | <1 | <5 | <5 | <1 |
| L-1754 | <5 | <5 | <1 | <5 | <5 | <1 | <5 | <5 | <1 |
| F-AP | <5 | <5 | <1 | <5 | <5 | <1 | <5 | <5 | <1 |
| MY | <5 | <5 | <1 | <5 | <5 | <1 | <5 | <5 | <1 |
| *Candida cyl.* | <5 | <5 | <1 | <5 | <5 | <1 | <5 | <5 | <1 |
| N | <5 | <5 | <1 | <5 | <5 | <1 | <5 | <5 | <1 |

| | DPDA activity(1) | | | MPS activity(1) | | | P15 activity(1) | | |
|---|---|---|---|---|---|---|---|---|---|
| Lipase | 10 min | 30 min | t½ (min) | 10 min | 30 min | t½ (min) | 10 min | 30 min | t½ (min) |
| *Ps. gladioli* | 90 | 70 | >60 | 63 | 47 | 20 | 81 | 42 | 26 |

-continued

| | | | | | | | | | |
|---|---|---|---|---|---|---|---|---|---|
| Amano P | 60 | 24 | 12 | 43 | 27 | 8 | 55 | 15 | 11 |
| Diosynth | 78 | 62 | >40 | 67 | 52 | 32 | 78 | 32 | 19 |
| Amano CE | 86 | 91 | * | 100 | 92 | * | 87 | 82 | * |
| Amano B | 100 | 86 | * | 97 | 66 | * | 93 | 85 | * |
| Amano CES | 57 | 32 | 14 | 89 | 76 | * | 43 | 20 | 8 |
| *Th. lanuginosus* | 95 | 90 | * | 91 | 75 | * | 87 | 81 | * |
| *Ps. cepacia* | 59 | 42 | 18 | 54 | 32 | 12 | 65 | 28 | 17 |
| Toyo Jozo | 82 | 52 | 33 | 38 | 22 | 8 | 74 | 29 | 17 |
| Amano AP6 | 61 | 15 | 12 | 91 | 79 | * | 55 | 24 | 11 |
| Esterase MM | 68 | 25 | 16 | 10 | <5 | 5 | 74 | 25 | 17 |
| Novo SP285 | 24 | <5 | 5 | 16 | <5 | 4 | 20 | <5 | 4 |
| Novo SP225 | 97 | 73 | * | 30 | 8 | 7 | 88 | 51 | 30 |
| PL (batch 2) | 20 | <5 | 5 | 14 | <5 | 5 | 23 | 9 | 4 |
| L-3126 | 13 | <5 | <1 | 7 | <5 | <1 | 7 | <5 | <1 |
| S80,000 | <5 | <5 | <1 | <5 | <5 | <1 | <5 | <5 | <1 |
| M-AP | 87 | 53 | 33 | 14 | <5 | 4 | 30 | <5 | 8 |
| ENZECO | <5 | <5 | <1 | <5 | <5 | <1 | <5 | <5 | <1 |
| Lipase 2A | <5 | <5 | <1 | <5 | <5 | <1 | <5 | <5 | <1 |
| Lipase 2B | <5 | <5 | <1 | <5 | <5 | <1 | <5 | <5 | <1 |
| OF 360 | <5 | <5 | <1 | <5 | <5 | <1 | <5 | <5 | <1 |
| L-1754 | <5 | <5 | <1 | <5 | <5 | <1 | <5 | <5 | <1 |
| F-AP | <5 | <5 | <1 | <5 | <5 | <1 | <5 | <5 | <1 |
| MY | <5 | <5 | <1 | <5 | <5 | <1 | <5 | <5 | <1 |
| *Candida cyl.* | <5 | <5 | <1 | <5 | <5 | <1 | <5 | <5 | <1 |
| N | <5 | <5 | <1 | <5 | <5 | <1 | <5 | <5 | <1 |

*too large to determine from these experiments
(1)residual lipase activity (% of input)
$t_{\frac{1}{2}}$ = half time life Reflectance values of the combined lipase/protease/bleach systems ($R_{460}$* after third cycle)

| Cloth | Bleach | Lipase TJ | AP | NO lipase |
|---|---|---|---|---|
| Sateh sauce | SNOBS | 74.0 | 75.5 | 72.3 |
| | TAED | 71.2 | 71.9 | 69.0 |
| | NO bleach | 65.6 | 66.2 | 64.8 |
| Mustard | SNOBS | 74.3 | 73.6 | 72.5 |
| | TAED | 70.6 | 69.8 | 68.6 |
| | NO bleach | 66.8 | 65.6 | 65.1 |
| PCBCl | SNOBS | 36.9 | 36.9 | 36.5 |
| | TAED | 34.4 | 34.8 | 33.9 |
| | NO bleach | 27.0 | 26.6 | 26.8 |

Residual fat data (% fat after third cycle)

| Cloth | Bleach | Lipase TJ | AP | NO lipase |
|---|---|---|---|---|
| Sateh sauce | SNOBS | 3.9 | 3.1 | 7.0 |
| | TAED | 4.1 | 3.4 | 7.0 |
| | DPDA | 3.6 | 3.0 | 7.0 |
| | MPS | 6.0 | 2.9 | 7.0 |
| | NO bleach | 4.0 | 3.6 | 7.0 |
| Mustard | SNOBS | 1.8 | 1.2 | 2.2. |
| | TAED | 1.8 | 1.3 | 2.2 |
| | DPDA | 1.6 | 1.2 | 2.2 |
| | MPS | 1.9 | 1.2 | 2.2 |
| | NO bleach | 1.5 | 1.3 | 2.2 |

EXAMPLE 4

Wash and bleach tests were carried out using the following formulation:

| | % by weight |
|---|---|
| Sodium dodecyl benzene sulphonate | 8.5 |
| $C_{12}$–$C_{15}$ primary alcohol, condensed with 7 moles of ethylene oxide | 4.0 |
| Sodium-hardened rapeseed oil soap | 1.5 |
| Sodium triphosphate | 33.0 |
| Sodium carbonate | 5.0 |
| Sodium silicate | 6.0 |
| Sodium sulphate | 20.0 |
| Water | 9.0 |
| Fluorescers, soil-suspending agents, dyes, perfumes | minor amount |
| Anti-foam granules | 1.2 |
| Dequest ® 2047 (34% pure) | 0.3 |

This composition was used in a concentration of 4.28 g/l. The washing was carried out as follows: Washing for 5 minutes at 30° C., thereafter adding citric acid to a pH of 8.5–9.0 and subsequently washing for 25 minutes at 30° C.

The same washing tests were carried out with the above formulation (4.28 g/l), to which 0.292 g/l TAED (65% pure) and 0.7 g/l sodium perborate monohydrate were added (yielding 1.5 mmol peracid in solution), or to which 1.88 g/l DPDA (12% pure) was added (yielding 1.5 mmol peracid in solution).

Test cloths:

Single wash monitor: BCl.

Multi-wash monitor: cotton test cloth soiled with a mixture of inorganic pigments, groundnut oil and milk powder (test cloth A) or a mixture of inorganic pigments, palm oil and protein (cocktail 2) (test cloth B).

Results:

Bleach effect(1) (ΔR460*)

(1)Mean data, no significant differences between runs ± lipase.

| Bleach | BC-1 |
|---|---|
| TAED | 6.5 |
| DPDA | 8.9 |
| NO | −0.7 |

| | Multi wash | | | | | | | | | |
|---|---|---|---|---|---|---|---|---|---|---|
| | Cloth | | | | | | | | | |
| | AS8/ANO/MP | | | | | AS8/PO/C2 | | | | |
| | Lipase | | | | | | | | | |
| Bleach | Cepacia SP341 | Gladioli | Esterase MM | Saiken A300 | NO | Cepacia SP 341 | Gladioli | Esterase MM | Saiken A300 | NO |
| | Residual fat* after fourth cycle | | | | | | | | | |
| TAED | 3.5 | 3.6 | 3.6 | 4.8 | 4.4 | 10.4 | 11.1 | 11.1 | 17.1 | 16.4 |
| DPDA | 3.8 | 3.8 | 3.7 | 4.3 | 5.1 | 10.6 | 9.7 | 10.1 | 15.7 | 17.9 |
| NO | 3.1 | 3.3 | 3.8 | 4.2 | 4.3 | 9.7 | 10.1 | 11.1 | 14.7 | 16.3 |
| | Relectance values after fourth cycle: | | | | | | | | | |
| TAED | 81.2 | 81.5 | 80.4 | 74.7 | 75.3 | 54.0 | 53.7 | 53.9 | 49.7 | 50.2 |
| DPDA | 83.4 | 83.4 | 83.0 | 78.9 | 75.9 | 53.9 | 54.1 | 53.0 | 50.6 | 49.2 |
| NO | 80.8 | 80.5 | 78.2 | 75.9 | 75.3 | 45.1 | 51.3 | 44.0 | 42.8 | 38.3 |

EXAMPLE 5

The performance of Cepacia lipase and lipase from Mucor miehei (SP225 ex NOVO) in the presence of TAED/perborate and P15/perborate was tested on test cloths in washing machines using the composition of Example 4 (the base powder)+Savinase$^R$.

4° wash result of MCSW.

Monitors single wash: AS10 (for protease performance) BCl (for bleach performance) EMPA 114 (for bleach performance)

multi wash: Cotton test cloths soiled with a mixture of inorganic pigments, palm oil and protein (cocktail 2)

Conditions 3.5 g/l base powder 30 min. 40° C.

40° FH protease: 20 GU/ml Savinase lipase: Cepacia lipase or SP225: 3 LU/ml bleach: 428 mg/l P15 (70% pure)+467 mg/l perborate monohydrate or 195 mg/l TAED (65% pure)+467 mg/l perborate monohydrate giving 1.0 mmol peracid in solution 3.5 kg soiled load present.

The results on multi-wash monitor were:

| Residual fat data (% F.M.) | | | | Reflectance of test cloth (ΔR460*) | | | |
|---|---|---|---|---|---|---|---|
| | Lipase | | | | Lipase | | |
| Bleach | Cepacia | SP225 | NO | Bleach | Cepacia | SP225 | NO |
| TAED | 9.5 | 11.9 | 12.4 | TAED | 71.8 | 68.8 | 67.8 |
| P15 | 11.0 | 13.0 | 14.4 | P15 | 69.8 | 67.6 | 65.0 |
| NO | — | — | 14.0 | NO | — | — | 59.1 |

Lipase effect on multi-wash monitor

| Fat removal (Δ% F.M.) | | | Reflectance benefit (ΔR460*) | | |
|---|---|---|---|---|---|
| | Lipase | | | Lipase | |
| Bleach | Cepacia | SP225 | Bleach | Cepacia | SP225 |
| TAED | 2.9 | 0.5 | TAED | 4.0 | 1.0 |
| P15 | 3.4 | 1.4 | P15 | 4.8 | 2.6 |

Bleach effect 1 (ΔR460*) Protease effect 1 (ΔR460*)

| Bleach | BC-1 | EMPA 114 | Protease | AS 10 |
|---|---|---|---|---|
| TAED | 6.6 | 23.2 | Savinase | 34.8 |
| P15 | 12.9 | 28.3 | NO | 9.8 |
| NO | 0.5 | 14.4 | | |

What is claimed is:

1. A detergent composition comprising from 1–50% by weight of one or more detergent-active materials, from 0–60% by weight of a builder, from 1–50% by weight of a bleaching agent and lipolytic enzymes in an amount of 0.005–100 lipolytic units per milligram of the composition, wherein the bleaching agent is based on an inorganic or organic peracid or salt thereof which is stronger than peracetic acid or comprises a bleaching agent and a bleach precursor which yields, on perhydrolysis, a peracid faster than the system sodium perborate+tetraacetyl ethylene diamine, and the lipolytic enzyme is a fungal lipase obtained from *Humicola lanuginosa* or *Thermomyces lanuginosus.*

2. A composition according to claim 1, wherein the bleaching agent is an alkali metal persulphate.

3. A composition according to claim 1, wherein the bleaching agent is selected from the group consisting of diperoxy dodecanedioic acid, diperoxy tetradecanedioic acid, diperoxyhexadecane dioic acid, mono- and diperazelaic acid, mono- and diperbrassylic acid, monoperoxy phthalic acid, perbenzoic acid, and their salts.

4. A composition according to claim 1, wherein the bleaching agent comprises a bleaching agent and a bleach precursor which forms a peracid in solution at least two times faster than tetraacetyl ethylene diamine under the same conditions.

5. A composition according to claim 4, wherein the bleaching agent comprises sodium perborate and a bleach precursor selected from the group consisting of sodium nonanoyloxy benzene sulphonate, sodium trimethyl hexanoyloxy benzene sulphonate, sodium acetoxy benzene sulphonate and sodium benzoyloxy benzene sulphonate.

6. A composition according to any one of claims 1–5, wherein it further contains a proteolytic enzyme in an amount of 0.1–50 GU/mg of the composition.

* * * * *